US011315724B2

(12) United States Patent
Park

(10) Patent No.: US 11,315,724 B2
(45) Date of Patent: Apr. 26, 2022

(54) INDUCTOR

(71) Applicant: SAMSUNG ELECTRO-MECHANICS CO., LTD., Suwon-si (KR)

(72) Inventor: Yong Sun Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 577 days.

(21) Appl. No.: 16/150,775

(22) Filed: Oct. 3, 2018

(65) Prior Publication Data

US 2019/0311844 A1 Oct. 10, 2019

(30) Foreign Application Priority Data

Apr. 9, 2018 (KR) ..... 10-2018-0041069

(51) Int. Cl.

| | |
|---|---|
| ***H01F 5/00*** | (2006.01) |
| ***H01F 27/32*** | (2006.01) |
| ***H01F 27/29*** | (2006.01) |
| *H01F 27/28* | (2006.01) |

(52) U.S. Cl.
CPC ..... *H01F 27/32* (2013.01); *H01F 27/292* (2013.01); *H01F 2027/2809* (2013.01)

(58) Field of Classification Search
USPC ..... 336/200
See application file for complete search history.

(56) References Cited

U.S. PATENT DOCUMENTS

| | | | | |
|---|---|---|---|---|
| 10,056,181 | B2 | 8/2018 | Yosui | |
| 2016/0163442 | A1* | 6/2016 | Yoon | H01F 27/008 336/200 |
| 2016/0293322 | A1* | 10/2016 | Yosui | H01F 41/042 |
| 2018/0012696 | A1 | 1/2018 | Lee et al. | |

FOREIGN PATENT DOCUMENTS

| | | | |
|---|---|---|---|
| CN | 105679490 | A | 6/2016 |
| CN | 206022030 | U | 3/2017 |
| EP | 1011115 | A1 | 6/2000 |
| JP | 2007-227729 | A | 9/2007 |
| KR | 10-0317116 | B1 | 4/2002 |
| KR | 10-2004-0002120 | A | 1/2004 |
| KR | 10-2016-0031391 | A | 3/2016 |
| KR | 10-2016-0069372 | A | 6/2016 |

(Continued)

OTHER PUBLICATIONS

English translation of EP1011115A1 (Year: 1999).*

(Continued)

*Primary Examiner* — Ronald Hinson
(74) *Attorney, Agent, or Firm* — Morgan, Lewis & Bockius LLP

(57) ABSTRACT

An inductor includes: a body in which a plurality of insulating layers having a plurality of coil patterns each disposed on each of the plurality of insulating layers are stacked; and first and second external electrodes disposed on an exterior surface of the body, wherein the body further includes a through-hole, and at least one portion of an inner surface of the plurality of coil patterns is exposed through the through-hole.

5 Claims, 7 Drawing Sheets

(56) References Cited

FOREIGN PATENT DOCUMENTS

KR 10-2018-0006246 A 1/2018

OTHER PUBLICATIONS

Office Action issued in Korean Patent Application No. 10-2018-0041069 dated Apr. 23, 2019, with English translation.
First Office Action issued in corresponding Chinese Patent Application No. 201811465988.3 dated Feb. 26, 2021, with English translation.
Chinese Office Action dated Nov. 1, 2021, issued in corresponding Chinese Patent Application No. 201811465988.3.

* cited by examiner

INDUCTOR

CROSS-REFERENCE TO RELATED APPLICATION(S)

This application claims the benefit of priority to Korean Patent Application No. 10-2018-0041069 filed on Apr. 9, 2018 in the Korean Intellectual Property Office, the disclosure of which is incorporated herein by reference in its entirety.

TECHNICAL FIELD

The present disclosure relates to an inductor.

BACKGROUND

Recently, in smartphones, signals in multiple frequency bands are used due to the application of multi-band long term evolution (LTE). As a result, a high frequency inductor is mainly used in impedance matching circuits in a signal transmission and reception RF system. The high frequency inductor is required to have a small size and high capacity. In addition, it is required that the high frequency inductor have a self resonant frequency (SRF) in a high frequency band and low resistivity to be usable at a high frequency of 100 MHz or more. Further, high Q characteristics are required to reduce loss at a frequency of use.

SUMMARY

An aspect of the present disclosure may provide an inductor capable of implementing a high self resonant frequency (SRF) and high Q characteristics.

According to an aspect of the present disclosure, an inductor may include: a body in which a plurality of insulating layers having a plurality of coil patterns each disposed on each of the plurality of insulating layers are stacked; and first and second external electrodes disposed on an exterior surface of the body, wherein the body further includes a through-hole, and at least one portion of an inner surface of plurality of the coil patterns is exposed through the through-hole.

According to another aspect of the present disclosure, an inductor may include: a body in which a plurality of insulating layers having a plurality of coil patterns each disposed on each of the plurality of insulating layers are stacked; and first and second external electrodes disposed on an exterior surface of the body, wherein the body further includes a through-hole having an insulating film disposed therein, a material of the insulating film being different from a material of the plurality of insulating layers, and at least one portion of an inner surface of the plurality of coil patterns is exposed through the insulating film of the through-hole.

BRIEF DESCRIPTION OF DRAWINGS

The above and other aspects, features and other advantages of the present invention will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Figure 1:
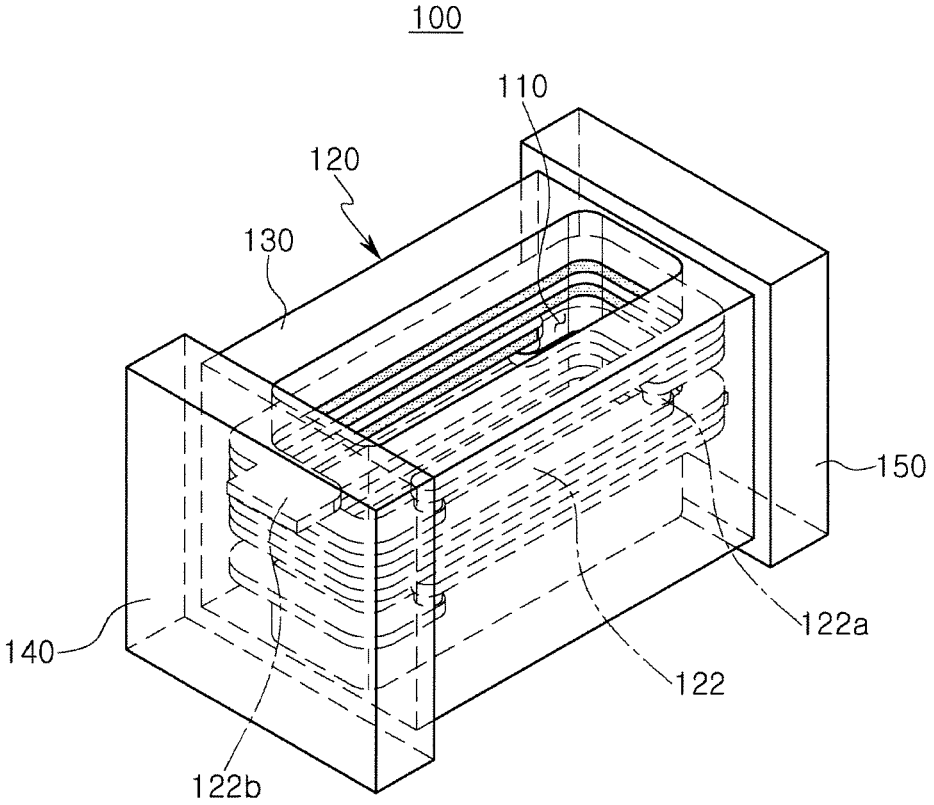
FIG. 1 is a schematic perspective view illustrating an inductor according to a first embodiment in the present disclosure.
Figure 2:
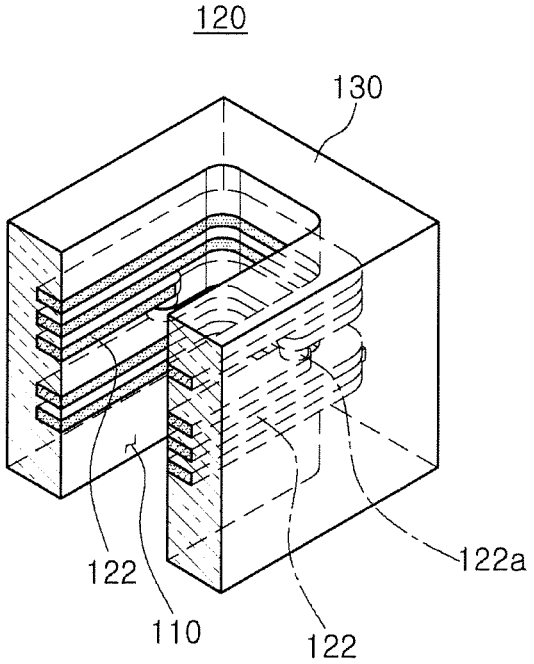
FIG. 2 is a partially cut-away perspective view illustrating the inductor according to the first embodiment in the present disclosure.

FIG. 1 is a schematic perspective view illustrating an inductor 100 according to a first embodiment in the present disclosure; and FIG. 2 is a partially cut-away perspective view illustrating the inductor 100 according to a first embodiment in the present disclosure.

Referring to FIGS. 1 and 2, the inductor 100 according to the first embodiment in the present disclosure may include a body 120, a first external electrode 140, and a second external electrode 150, as an example.

The body 120 may be formed by stacking a plurality of insulating layers 130 on which coil patterns 122 are disposed. As an example, the plurality of insulating layers 130 may be sequentially stacked from the bottom to the top. Further, the insulating layer 130 may be a magnetic layer or a dielectric layer.

Where the insulating layer 130 is a dielectric layer, the insulating layer 130 may include $BaTiO_3$ (barium titanate)-based ceramic powder, or the like. In this case, examples of the $BaTiO_3$-based ceramic powder may include $(Ba_{1-x}Ca_x)TiO_3$, $Ba(Ti_{1-y}Ca_y)O_3$, $(Ba_{1-x}Ca_x)(Ti_{1-y}Zr_y)O_3$, $Ba(Ti_{1-y}Zr_y)O_3$, and the like, in which Ca, Zr, or the like, is partially solid-dissolved in $BaTiO_3$. However, the $BaTiO_3$-based ceramic powder in the present disclosure is not limited thereto.

Where the insulating layer 130 is a magnetic layer, the insulating layer 130 may include a proper material selected from materials that are usable in a body of an inductor, and examples of the proper material may include a resin, ceramic, ferrite, and the like.

In the present embodiment, the dielectric layer may be formed of a photosensitive insulating material, thereby implementing fine patterns through a photolithography process. In other words, by forming the dielectric layer with the photosensitive insulating material, the coil pattern 122 may be finely formed to contribute to miniaturization and function improvement of the inductor 100. To this end, the dielectric layer may include, for example, a photosensitive organic material or a photosensitive resin. In addition, the dielectric layer may further include an inorganic component such as $SiO_2/Al_2O_3/BaSO_4$/Talc, or the like, as a filler component.

The coil pattern 122 may have a plurality of layers, and neighboring coil patterns 122 may be electrically connected by a coil connection portion 122*a*. In other words, the helical coil pattern 122 may be connected by the coil connection portion 122*a* to form a coil. Both ends of the coil may be connected to the first and second external electrodes 140 and 150, respectively, by a coil lead portion 122*b*. The coil lead portion 122*b* may have a wider line width than that of the coil pattern 122 in order to improve connectivity between the coil patterns 122.

The coil pattern 122 may be formed of a material having high conductivity, for example, a material that is capable of preventing from oxidation by air contact. For example, the coil pattern 122 may be formed of silver (Ag), gold (Au), platinum (Pt), or alloys thereof. Further, the coil pattern 122 may be formed by a plating method or a printing method, but is not limited thereto.

Meanwhile, the body 120 may have a through-hole 110 formed therein. The through-hole 110 may have a shape corresponding to a shape of the coil pattern 122. In the present embodiment, the through-hole 110 may be formed to have a tetragonal shape corresponding to the shape of the coil pattern 122, but the shape of the through-hole 110 is not limited thereto and may be any one of elliptical shape and polygonal shape.

In addition, the coil pattern 122 may be exposed through the through-hole 110. In other words, an inner surface of the coil pattern 122 may be entirely exposed through the through-hole 110. That is, the through-hole 110 may have such a size that the inner surface of the coil pattern 122 may be exposed. In addition, the through-hole 110 may be processed by drilling, laser, or the like depending on the material.

As described above, the insulating layer 130 formed of a dielectric that interrupts flow of magnetic flux of the coil pattern 122 may be removed from an inside of the coil pattern 122 through the through-hole 110, such that higher Q characteristics and a high self resonant frequency (SRF) may be implemented.

The first and second external electrodes 140 and 150 may be disposed at both ends of the body 120.

For example, the first and second external electrodes 140 and 150 may be disposed vertically with respect to a mounting surface of the body 120. The mounting surface refers to a surface on which the inductor faces a printed circuit board when the inductor is mounted on the printed circuit board.

The first and second external electrodes 140 and 150 may serve to electrically connect the inductor 100 to a printed circuit board when the inductor 100 is mounted on the PCB. To this end, the first and second external electrodes 140 and 150 may be extended to a bottom surface of the body 120. The first and second external electrodes 140 and 150 may include, for example, a conductive resin layer and a conductor layer formed on the conductive resin layer, but the present disclosure is not limited thereto. The conductive resin layer may include at least any one conductive metal selected from the group consisting of copper (Cu), nickel (Ni), and silver (Ag), and a thermosetting resin. The conductor layer may include any one or more selected from the group consisting of nickel (Ni), copper (Cu), and tin (Sn). For example, a nickel (Ni) layer and a tin (Sn) layer may be sequentially formed.

As described above, the insulating layer 130 formed of a dielectric that interrupts flow of magnetic flux of the coil pattern 122 may be removed from an inside of the coil pattern 122 through the through-hole 110, such that higher Q characteristics and a high self resonant frequency (SRF) may be implemented.

Figure 3:
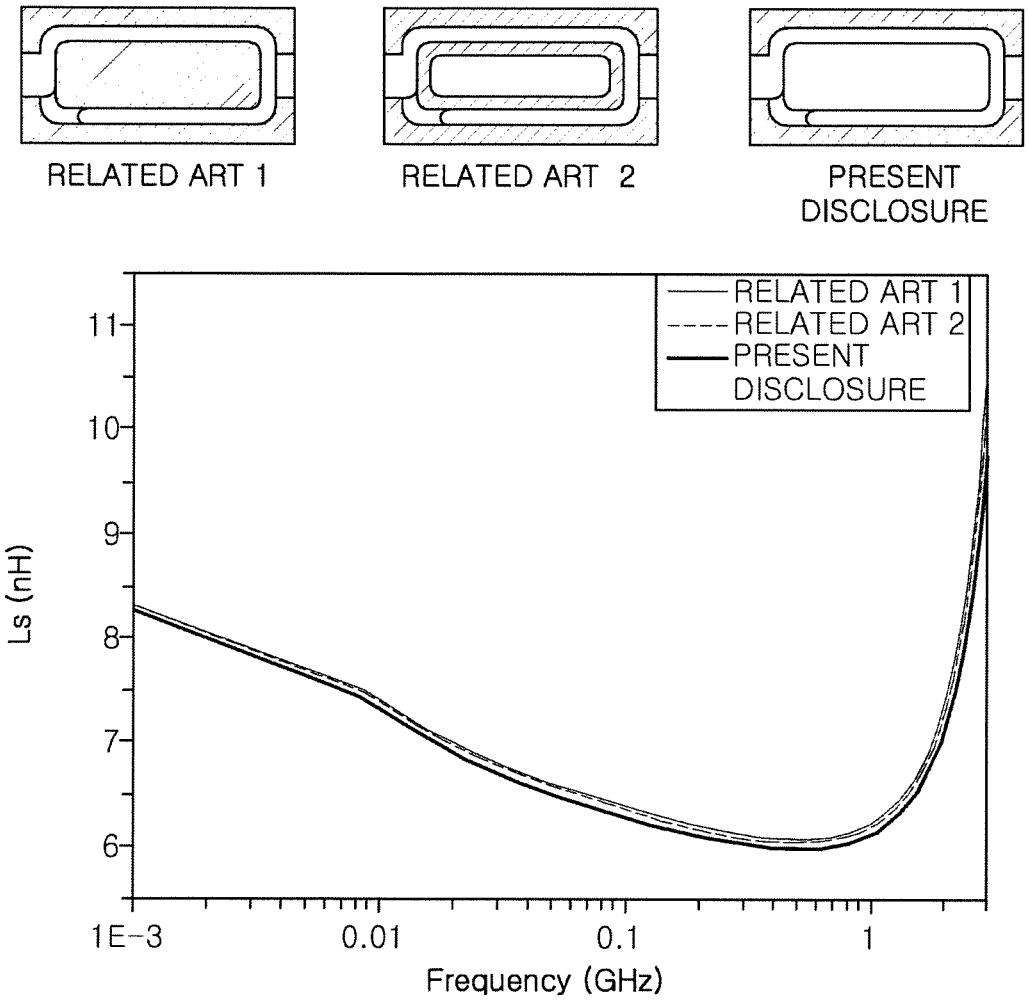
FIGS. 3 through 5 are graphs illustrating effects of the inductor compared to the related art according to the first embodiment in the present disclosure.
Figure 4:
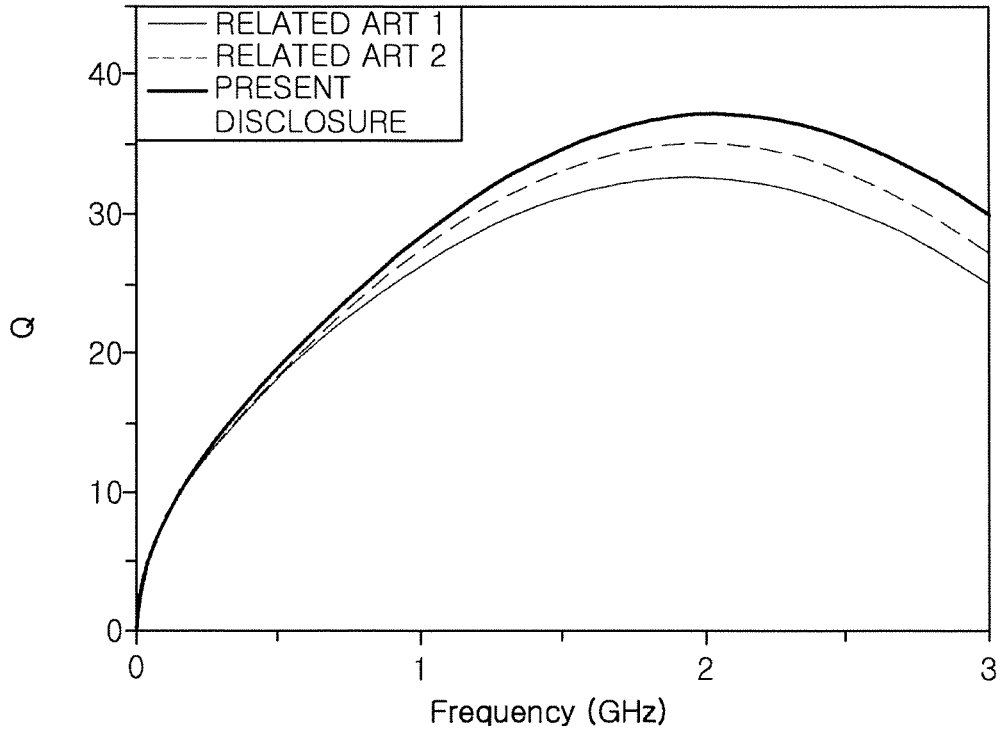
Figure 5:
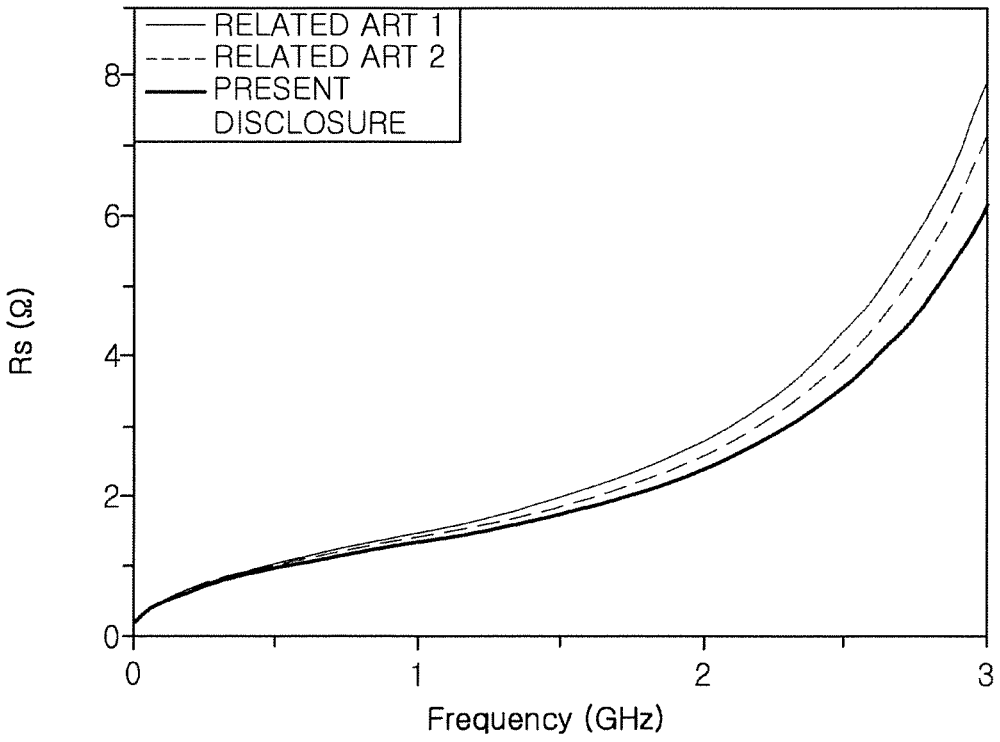

Meanwhile, FIGS. 3 through 5 are graphs illustrating effects of the inductor compared to the related art according to a first embodiment in the present disclosure. Table 1, as shown below, includes values of inductance, Q performance, and AC resistance that correspond to the graphs illustrated in FIGS. 3 through 5.

TABLE 1

| | Inductance (nH) | | Q Performance Frequency [MHz] | | | | | | AC Resistance (Ω) | | | |
|---|---|---|---|---|---|---|---|---|---|---|---|---|
| Classification | 100 | 500 | 100 | 500 | 1000 | 2000 | 2400 | 100 | 500 | 1000 | 2000 | 2400 |
| Related Art 1 | 6.38 | 6.07 | 8.11 | 18.19 | 26.29 | 32.69 | 31.22 | 0.49 | 1.05 | 1.49 | 2.82 | 3.97 |
| Related Art 2 | 6.35 | 6.04 | 8.00 | 18.39 | 27.40 | 35.15 | 33.74 | 0.50 | 1.03 | 1.42 | 2.60 | 3.64 |
| Present disclosure | 6.33 | 6.02 | 8.00 | 18.90 | 28.44 | 37.22 | 36.15 | 0.49 | 0.99 | 1.35 | 2.40 | 3.29 |

As shown in FIG. 3, it may be appreciated that in embodiment, there is almost no change in inductance as compared with the related arts 1 and 2.

In addition, as shown in FIG. 4, it may be appreciated that the Q performance is improved by about 8 to 16% as compared with the related arts 1 and 2.

Further, as shown in FIG. 5, it may be appreciated that the self resonant frequency (SRF) has a synergistic effect of approximately 1000 MHz or more as compared with the related arts 1 and 2.

As described above, since the inner surface of the coil pattern 122 is exposed into the through-hole 110, high Q characteristics and a high self resonance frequency (SRF) may be implemented at an equivalent level of inductance.

Hereinafter, another embodiment in the present disclosure is described with reference to the accompanying drawings.

Figure 6:
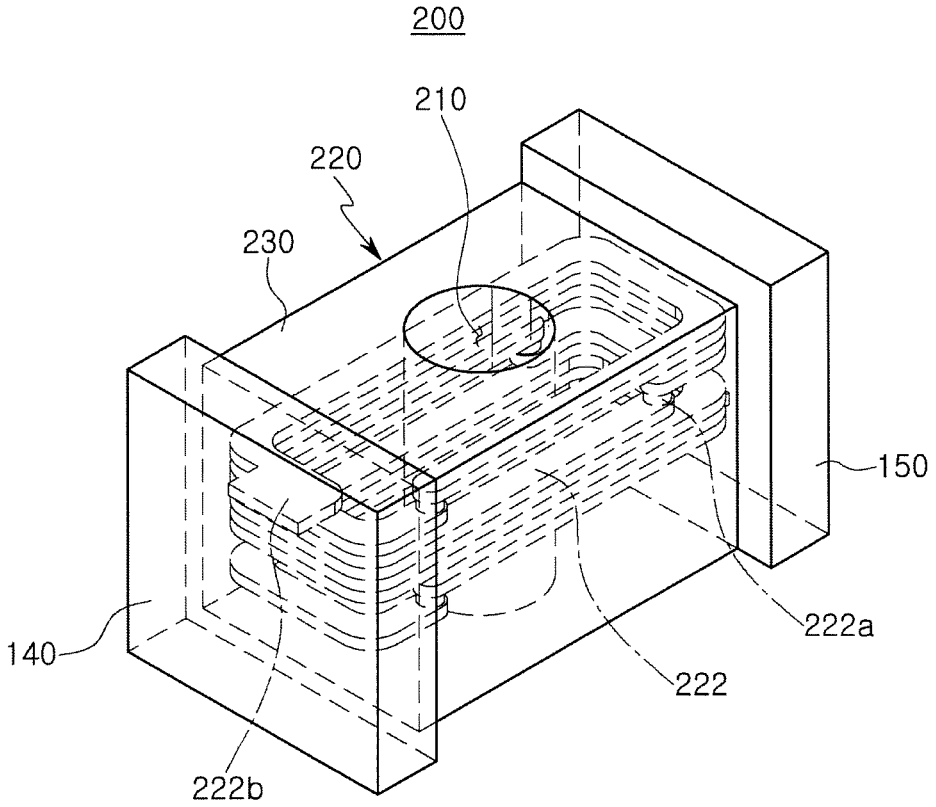
FIG. 6 is a schematic perspective view illustrating an inductor according to a second embodiment in the present disclosure.
Figure 7:
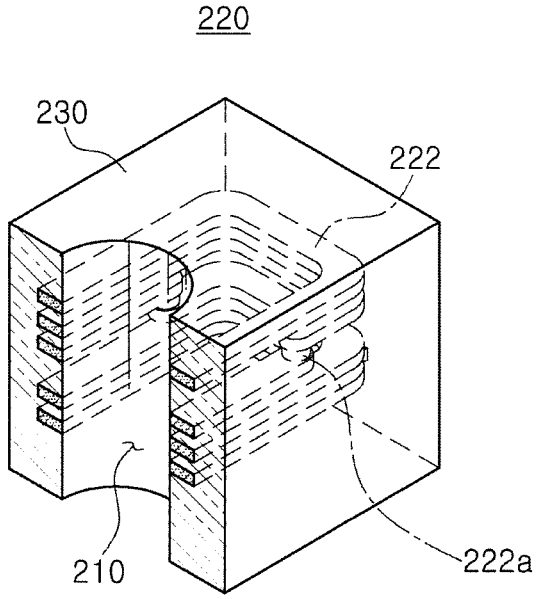
FIG. 7 is a partially cut-away perspective view illustrating the inductor according to the second embodiment in the present disclosure.

FIG. 6 is a schematic perspective view illustrating an inductor according to a second embodiment in the present disclosure, and FIG. 7 is a partially cut-away perspective view illustrating the inductor according to the second embodiment in the present disclosure.

Referring to FIGS. 6 and 7, the inductor 200 according to the second embodiment in the present disclosure may include a body 220, a first external electrode 140, and a second external electrode 150, as an example.

Meanwhile, since the first external electrode 140 and the second external electrode 150 correspond to the same components as those described above, detailed descriptions thereof are omitted, and may be substituted with the above descriptions.

The body 220 may be formed by stacking a plurality of insulating layers 230 on which coil patterns 222 are disposed. As an example, the plurality of insulating layers 230 may be sequentially stacked from the bottom to the top. Further, the insulating layer 230 may be a magnetic layer or a dielectric layer.

Where the insulating layer 230 is a dielectric layer, the insulating layer 130 may include $BaTiO_3$ (barium titanate)-based ceramic powder, or the like. In this case, examples of the $BaTiO_3$-based ceramic powder may include $(Ba_{1-x}Ca_x)TiO_3$, $Ba(Ti_{1-y}Ca_y)O_3$, $(Ba_{1-x}Ca_x)(Ti_{1-y}Zr_y)O_3$, $Ba(Ti_{1-y}Zr_y)O_3$, and the like, in which Ca, Zr, or the like, is partially solid-dissolved in $BaTiO_3$. However, the $BaTiO_3$-based ceramic powder in the present disclosure is not limited thereto.

Where the insulating layer 230 is a magnetic layer, the insulating layer 230 may include a proper material selected from materials that are usable as a body of an inductor, and examples of the proper material may include a resin, ceramic, ferrite, and the like.

In the present embodiment, the dielectric layer may be formed of a photosensitive insulating material, thereby implementing fine patterns through a photolithography process. In other words, by forming the dielectric layer with the photosensitive insulating material, the coil pattern 222 may be finely formed to contribute to miniaturization and function improvement of the inductor 200. To this end, the dielectric layer may include, for example, a photosensitive organic material or a photosensitive resin. In addition, the dielectric layer may further include an inorganic component such as $SiO_2/Al_2O_3/BaSO_4$/Talc, or the like, as a filler component.

The coil pattern 222 may have a plurality of layers, and neighboring coil patterns 222 may be electrically connected by a coil connection portion 222*a*. In other words, the helical coil pattern 222 may be connected by the coil connection portion 222*a* to form a coil. Both ends of the coil may be connected to the first and second external electrodes 140 and 150, respectively, by a coil lead portion 222*b*. The coil lead portion 222*b* may have a wider line width than that of the coil pattern 222 in order to improve connectivity between the coil patterns 222.

The coil pattern 222 may be formed of a material having high conductivity, for example, a material that is capable of being prevented from oxidation by air contact. For example, the coil pattern 222 may be formed of silver (Ag), gold (Au), platinum (Pt), or alloys thereof. Further, the coil pattern 222 may be formed by a plating method or a printing method, but is not limited thereto.

Meanwhile, the body 220 may have a through-hole 210 formed therein. The through-hole 210 may have a cylindrical shape disposed at a central portion of the coil pattern 222. In the present embodiment, the through-hole 210 may be formed to have a cylindrical shape, but the shape of the through-hole 210 is not limited thereto and may be any one of elliptical shape and polygonal shape.

In addition, a portion of the coil pattern 222 may be exposed through the through-hole 210. In other words, a portion of an inner surface of the coil pattern 222 may be exposed through the through-hole 210. That is, the through-hole 210 may have such a size that the portion of the inner surface of the coil pattern 222 may be exposed. In addition, the through-hole 210 may be processed by drilling, laser, or the like depending on the material.

As described above, the insulating layer 230 formed of a dielectric that interrupts flow of magnetic flux of the coil pattern 222 may be partially removed from an inside of the coil pattern 222 through the through-hole 210, such that higher Q characteristics and a high self resonant frequency (SRF) may be implemented.

Figure 8:
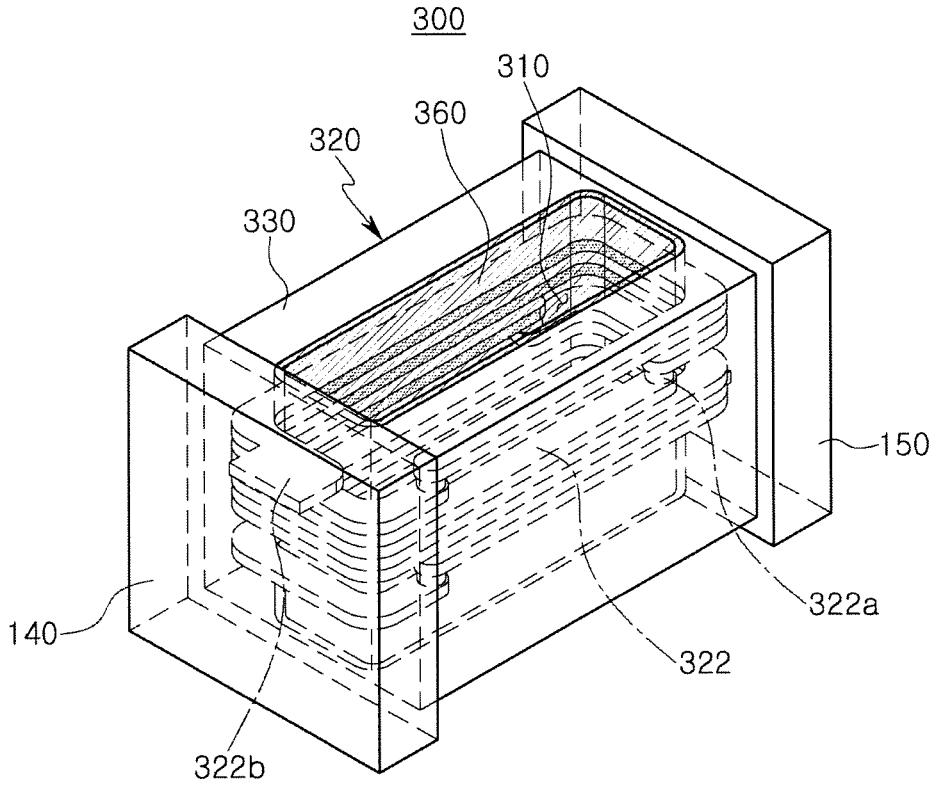
FIG. 8 is a schematic perspective view illustrating an inductor according to a third embodiment in the present disclosure.
Figure 9:
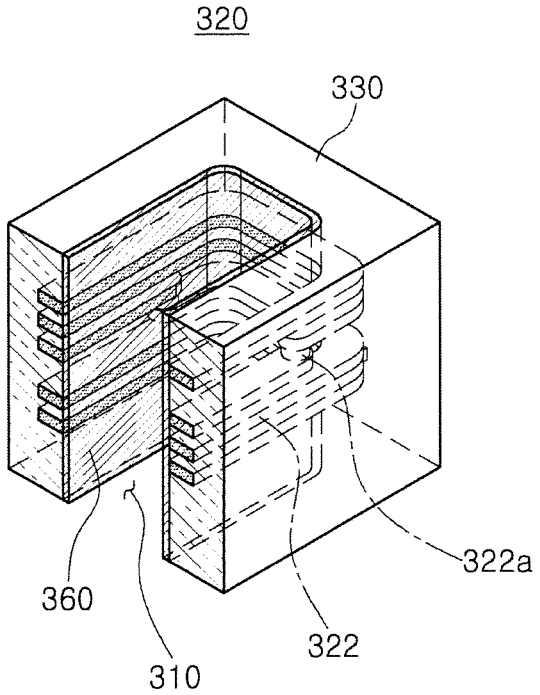
FIG. 9 is a partially cut-away perspective view illustrating the inductor according to the third embodiment in the present disclosure.

FIG. 8 is a schematic perspective view illustrating an inductor according to a third embodiment in the present disclosure, and FIG. 9 is a partially cut-away perspective view illustrating the inductor according to the third embodiment in the present disclosure.

Referring to FIGS. 8 and 9, an inductor 300 according to the third embodiment in the present disclosure may include a body 320, a first external electrode 140, a second external electrode 150, and an insulating film 360, as an example.

Meanwhile, since the first external electrode 140 and the second external electrode 150 correspond to the same components as those described above, detailed descriptions thereof are omitted, and may be substituted with the above descriptions.

The body 320 may be formed by stacking a plurality of insulating layers 330 on which coil patterns 322 are disposed. As an example, the plurality of insulating layers 330 may be sequentially stacked from the bottom to the top. Further, the insulating layer 330 may be a magnetic layer or a dielectric layer.

Where the insulating layer 330 is a dielectric layer, the insulating layer 330 may include $BaTiO_3$ (barium titanate)-based ceramic powder, or the like. In this case, examples of the $BaTiO_3$-based ceramic powder may include $(Ba_{1-x}Ca_x)TiO_3$, $Ba(Ti_{1-y}Ca_y)O_3$, $(Ba_{1-x}Ca_x)(Ti_{1-y}Zr_y)O_3$, $Ba(Ti_{1-y}Zr_y)O_3$, and the like, in which Ca, Zr, or the like, is partially solid-dissolved in $BaTiO_3$. However, the $BaTiO_3$-based ceramic powder in the present disclosure is not limited thereto.

Where the insulating layer 330 is a magnetic layer, the insulating layer 330 may include a proper material selected from materials that are usable as a body of an inductor, and examples of the proper material may include a resin, ceramic, ferrite, and the like.

In the present embodiment, the dielectric layer may be formed of a photosensitive insulating material, thereby implementing fine patterns through a photolithography process. In other words, by forming the dielectric layer with the photosensitive insulating material, the coil pattern 322 may be finely formed to contribute to miniaturization and function improvement of the inductor 300. To this end, the dielectric layer may include, for example, a photosensitive organic material or a photosensitive resin. In addition, the dielectric layer may further include an inorganic component such as $SiO_2/Al_2O_3/BaSO_4$/Talc, or the like, as a filler component.

The coil pattern 322 may have a plurality of layers, and neighboring coil patterns 322 may be electrically connected by a coil connection portion 322*a*. In other words, the helical coil pattern 322 may be connected by the coil connection portion 322*a* to form a coil. Both ends of the coil may be connected to the first and second external electrodes 140 and 150, respectively, by a coil lead portion 222*b*. The coil lead portion 322*b* may have a wider line width than that of the coil pattern 322 in order to improve connectivity between the coil patterns 322.

The coil pattern 322 may be formed of a material having excellent conductivity. For example, the coil pattern 322 may be formed of copper (Cu), aluminum (Al), tin (Sn), nickel (Ni), lead (Pb), silver (Ag), gold (Au), platinum (Pt), or alloys thereof. Further, the coil pattern 222 may be formed by a plating method or a printing method, but is not limited thereto.

Meanwhile, the body 320 may have a through-hole 310 formed therein. The through-hole 310 may have a shape corresponding to a shape of the coil pattern 322. In the present embodiment, the through-hole may be formed to have a tetragonal shape corresponding to the shape of the coil pattern 322, but the shape of the through-hole 310 is not limited thereto and may be any one of elliptical shape and polygonal shape.

In addition, the coil pattern 322 may be exposed through the through-hole 310. In other words, a portion of an inner surface of the coil pattern 322 may be exposed through the through-hole 310. That is, the through-hole 310 may have such a size that the portion of the inner surface of the coil pattern 322 may be exposed. In addition, the through-hole 310 may be processed by drilling, laser, or the like depending on the material.

As described above, the insulating layer 330 formed of a dielectric that interrupts flow of magnetic flux of the coil pattern 322 may be partially removed from an inside of the coil pattern 322 through the through-hole 310, such that higher Q characteristics and a high self resonant frequency (SRF) may be implemented.

The insulating film 360 may be formed to prevent corrosion of the coil pattern 322 due to moisture. The insulating film 360 may be formed of a thermoplastic insulating material or a thermosetting insulating material different from a material of the insulating layer 330. As an example, the insulating film 360 may be formed on an inner surface of the insulating layer 330 to cover the coil pattern 322 exposed through the through-hole 310.

Even though a case in which the insulating film 360 is entirely formed on the inner surface of the insulating layer 330 is described as an example in the present embodiment, the present disclosure is not limited thereto, and the insulating film 360 may be formed to cover only the coil pattern 322 to be exposed.

Figure 10:
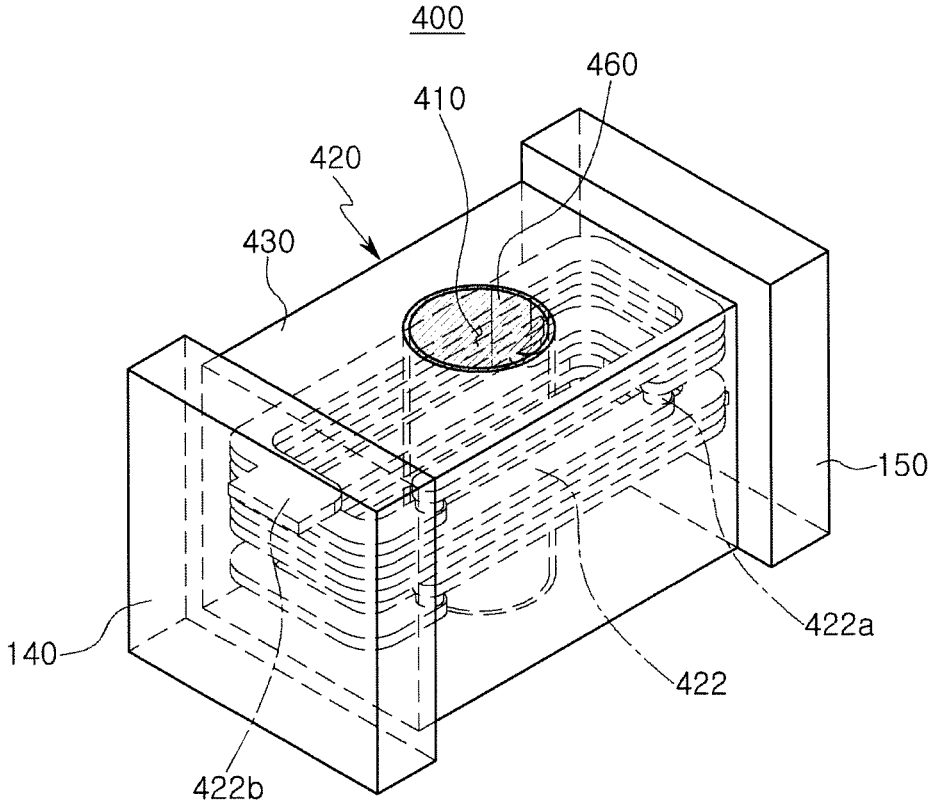
FIG. 10 is a schematic perspective view illustrating an inductor according to a fourth embodiment in the present disclosure.
Figure 11:
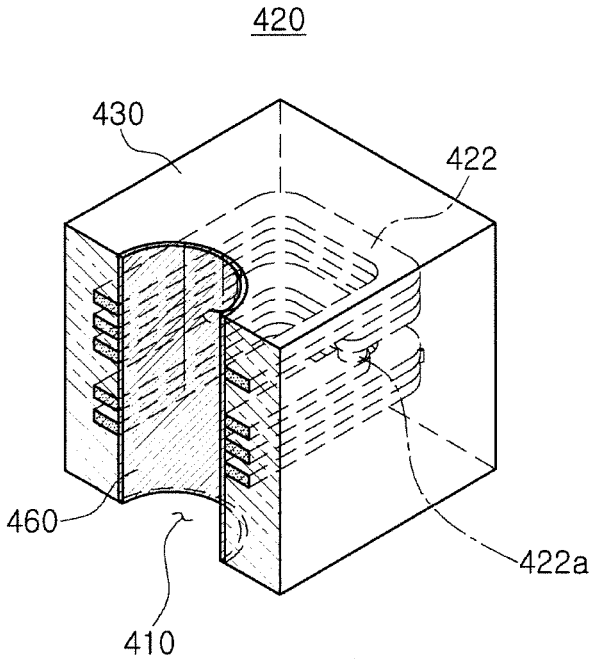
FIG. 11 is a partially cut-away perspective view illustrating the inductor according to the fourth embodiment in the present disclosure.

FIG. 10 is a schematic perspective view illustrating an inductor according to a fourth embodiment in the present disclosure, and FIG. 11 is a partially cut-away perspective view illustrating the inductor according to the fourth embodiment in the present disclosure.

Referring to FIGS. 10 and 11, the inductor 400 according to the fourth embodiment in the present disclosure may include a body 420, a first external electrode 140, a second external electrode 150, and an insulating film 460, as an example.

Meanwhile, since the first external electrode 140 and the second external electrode 150 correspond to the same components as those described above, detailed descriptions thereof are omitted, and may be substituted with the above descriptions.

The body 420 may be formed by stacking a plurality of insulating layers 430 on which coil patterns 422 are disposed. As an example, the plurality of insulating layers 430 may be sequentially stacked from the bottom to the top. Further, the insulating layer 430 may be a magnetic layer or a dielectric layer.

Where the insulating layer 430 is a dielectric layer, the insulating layer 430 may include $BaTiO_3$ (barium titanate)-based ceramic powder, or the like. In this case, examples of the $BaTiO_3$-based ceramic powder may include $(Ba_{1-x}Ca_x)TiO_3$, $Ba(Ti_{1-y}Ca_y)O_3$, $(Ba_{1-x}Ca_x)(Ti_{1-y}Zr_y)O_3$, $Ba(Ti_{1-y}Zr_y)O_3$, and the like, in which Ca, Zr, or the like, is partially solid-dissolved in $BaTiO_3$. However, the $BaTiO_3$-based ceramic powder in the present disclosure is not limited thereto.

Where the insulating layer 430 is a magnetic layer, the insulating layer 430 may include a proper material selected from materials that are usable as a body of an inductor, and examples of the proper material may include a resin, ceramic, ferrite, and the like.

In the present embodiment, the dielectric layer may be formed of a photosensitive insulating material, thereby implementing fine patterns through a photolithography process. In other words, by forming the dielectric layer with the photosensitive insulating material, the coil pattern 422 may be finely formed to contribute to miniaturization and function improvement of the inductor 400. To this end, the dielectric layer may include, for example, a photosensitive organic material or a photosensitive resin. In addition, the dielectric layer may further include an inorganic component such as $SiO_2/Al_2O_3/BaSO_4$/Talc, or the like, as a filler component.

The coil pattern 422 may have a plurality of layers, and neighboring coil patterns 422 may be electrically connected by a coil connection portion 422*a*. In other words, the helical coil pattern 422 may be connected by the coil connection portion 422*a* to form a coil. Both ends of the coil may be connected to the first and second external electrodes 140 and 150, respectively, by a coil lead portion 422*b*. The coil lead portion 422*b* may have a wider line width than that of the coil pattern 422 in order to improve connectivity between the coil patterns 422.

The coil pattern 422 may be formed of a material having excellent conductivity. For example, the coil pattern 422 may be formed of copper (Cu), aluminum (Al), tin (Sn), nickel (Ni), lead (Pb), silver (Ag), gold (Au), platinum (Pt), or alloys thereof. Further, the coil pattern 422 may be formed by a plating method or a printing method, but is not limited thereto.

Meanwhile, the body 420 may have a through-hole 410 formed therein. The through-hole 410 may have a cylindrical shape disposed at a central portion of the coil pattern 422. In the present embodiment, the through-hole 410 may be formed to have a cylindrical shape, but the shape of the through-hole 410 is not limited thereto and may be any one of elliptical shape and polygonal shape.

In addition, a portion of the coil pattern 422 may be exposed through the through-hole 410. In other words, a portion of an inner surface of the coil pattern 422 may be exposed through the through-hole 410. That is, the through-hole 410 may have such a size that the portion of the inner surface of the coil pattern 422 may be exposed. In addition, the through-hole 410 may be processed by drilling, laser, or the like depending on the material.

As described above, the insulating layer 430 formed of a dielectric that interrupts flow of magnetic flux of the coil pattern 422 may be partially removed from an inside of the coil pattern 422 through the through-hole 410, such that higher Q characteristics and a high self resonant frequency (SRF) may be implemented.

The insulating film 460 may be formed to prevent corrosion of the coil pattern 422 due to moisture. The insulating film 460 may be formed of a thermoplastic insulating material or a thermosetting insulating material different from a material of the insulating layer 430. As an example, the insulating film 460 may be formed on an inner surface of the insulating layer 430 to cover the coil pattern 422 exposed through the through-hole 410.

Even though a case in which the insulating film 460 is entirely formed on the inner surface of the insulating layer 430 is described as an example in the present embodiment, the present disclosure is not limited thereto, and the insulating film 460 may be formed to cover only the coil pattern 422 to be exposed.

Figure 12:
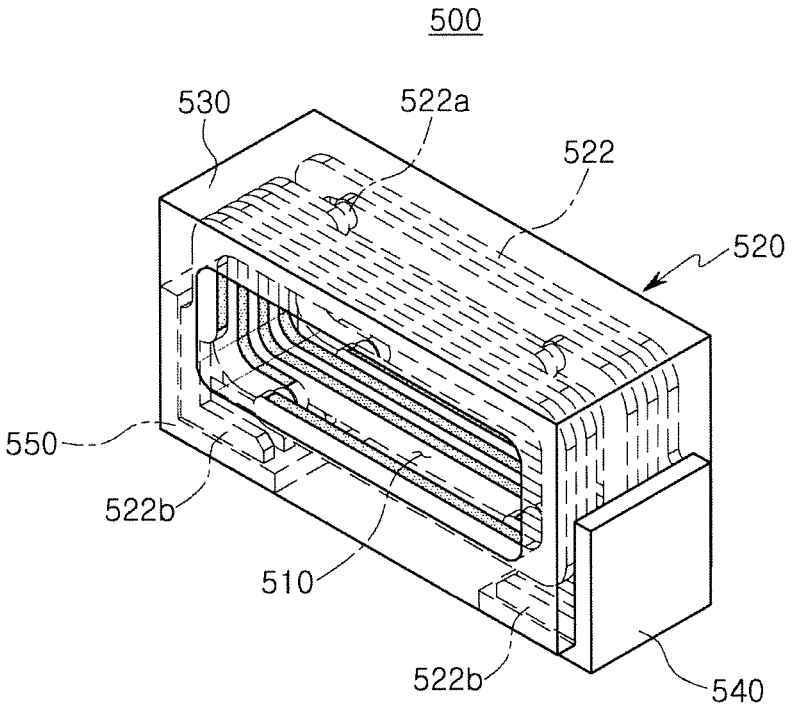
FIG. 12 is a schematic perspective view illustrating an inductor according to a fifth embodiment in the present disclosure.

FIG. 12 is a schematic perspective view illustrating an inductor according to a fifth embodiment in the present disclosure.

Referring to FIG. 12, the inductor 500 according to the fifth embodiment in the present disclosure may include a body 520, a first external electrode 540, and a second external electrode 550, as an example.

The body 520 may be formed by stacking a plurality of insulating layers 530 on which coil patterns 522 are disposed. As an example, the plurality of insulating layers 530 may be sequentially stacked in a vertical direction with respect to the mounting surface (i.e., a direction from a front surface to a rear surface of the body 520). Further, the insulating layer 530 may be a magnetic layer or a dielectric layer.

Where the insulating layer 530 is a dielectric layer, the insulating layer 530 may include $BaTiO_3$ (barium titanate)-based ceramic powder, or the like. In this case, examples of the $BaTiO_3$-based ceramic powder may include $(Ba_{1-x}Ca_x)TiO_3$, $Ba(Ti_{1-y}Ca_y)O_3$, $(Ba_{1-x}Ca_x)(Ti_{1-y}Zr_y)O_3$, $Ba(Ti_{1-y}Zr_y)O_3$, and the like, in which Ca, Zr, or the like, is partially solid-dissolved in $BaTiO_3$. However, the $BaTiO_3$-based ceramic powder in the present disclosure is not limited thereto.

Where the insulating layer 530 is a magnetic layer, the insulating layer 530 may include a proper material selected from materials that are usable as a body of an inductor, and examples of the proper material may include a resin, ceramic, ferrite, and the like.

In the present embodiment, the dielectric layer may be formed of a photosensitive insulating material, thereby implementing fine patterns through a photolithography process. In other words, by forming the dielectric layer with the photosensitive insulating material, the coil pattern 522 may be finely formed to contribute to miniaturization and function improvement of the inductor 500. To this end, the dielectric layer may include, for example, a photosensitive organic material or a photosensitive resin. In addition, the dielectric layer may further include an inorganic component such as $SiO_2/Al_2O_3/BaSO_4$/Talc, or the like, as a filler component.

The coil pattern 522 may have a plurality of layers, and neighboring coil patterns 522 may be electrically connected by a coil connection portion 522*a*. In other words, the helical coil pattern 522 may be connected by the coil connection portion 522*a* to form a coil. Both ends of the coil may be connected to the first and second external electrodes 540 and 550, respectively, by a coil lead portion 522*b*. The coil lead portion 522*b* may have a wider line width than that of the coil pattern 522 in order to improve connectivity between the coil patterns 522.

The coil pattern 522 may be formed of a material having high conductivity, for example, a material that is capable of being prevented from oxidation by air contact. For example, the coil pattern 522 may be formed of silver (Ag), gold (Au), platinum (Pt), or alloys thereof. Further, the coil pattern 522 may be formed by a plating method or a printing method, but is not limited thereto.

Meanwhile, the body 520 may have a through-hole 510 formed therein. The through-hole 510 may have a shape corresponding to a shape of the coil pattern 522. In the present embodiment, the through-hole 510 may be formed to have a tetragonal shape corresponding to the shape of the coil pattern 522, but the shape of the through-hole 510 is not limited thereto and may be any one of elliptical shape and polygonal shape.

In addition, the coil pattern 522 may be exposed through the through-hole 510. In other words, an inner surface of the coil pattern 522 may be entirely exposed through the through-hole 510. That is, the through-hole 510 may have such a size that the inner surface of the coil pattern 522 may be exposed. In addition, the through-hole 510 may be processed by drilling, laser, or the like depending on the material.

As described above, the insulating layer 530 formed of a dielectric that interrupts flow of magnetic flux of the coil pattern 522 may be removed from an inside of the coil pattern 522 through the through-hole 510, such that higher Q characteristics and a high self resonant frequency (SRF) may be implemented.

The first and second external electrodes 540 and 550 may be disposed at both ends of a bottom surface of the body 520.

For example, the first and second external electrodes 540 and 550 may be disposed vertically with respect to a mounting surface of the body 520. The mounting surface refers to a surface on which the inductor faces a printed circuit board when the inductor is mounted on the printed circuit board.

The first and second external electrodes 540 and 550 may serve to electrically connect the inductor 100 to a printed circuit board (PCB) when the inductor 500 is mounted on the PCB. To this end, the first and second external electrodes 540 and 550 may be extended from both side surfaces of the body 520 to the bottom surface. The first and second external electrodes 540 and 550 may include, for example, a conductive resin layer and a conductor layer formed on the conductive resin layer, but the present disclosure is not limited thereto. The conductive resin layer may include at least any one conductive metal selected from the group consisting of copper (Cu), nickel (Ni), and silver (Ag), and a thermosetting resin. The conductor layer may include any one or more selected from the group consisting of nickel (Ni), copper (Cu), and tin (Sn). For example, a nickel (Ni) layer and a tin (Sn) layer may be sequentially formed.

As described above, the insulating layer 530 formed of a dielectric that interrupts flow of magnetic flux of the coil pattern 522 may be removed from an inside of the coil pattern 522 through the through-hole 510, such that higher Q characteristics and a high self resonant frequency (SRF) may be implemented.

Figure 13:
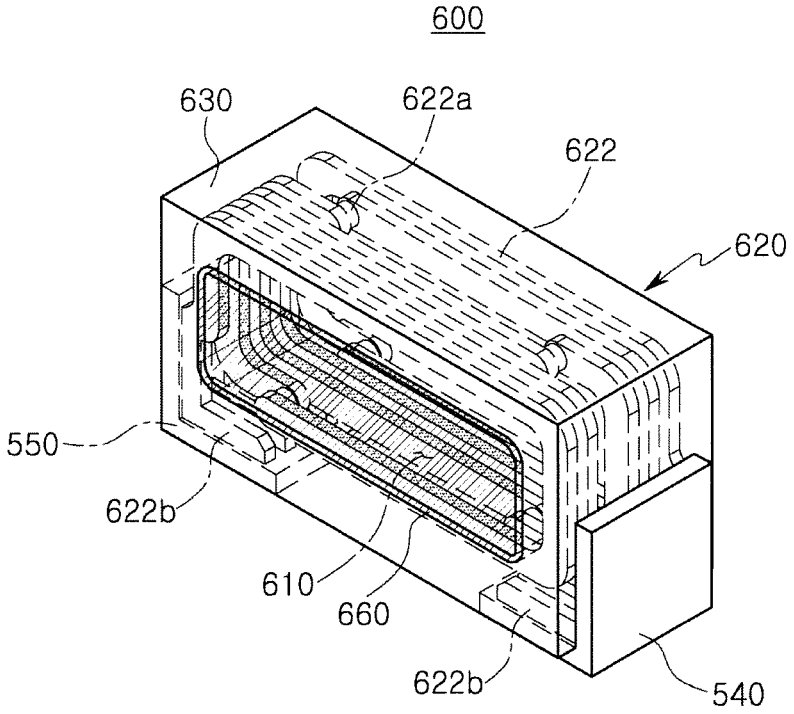
FIG. 13 is a schematic perspective view illustrating an inductor according to a sixth embodiment in the present disclosure.

FIG. 13 is a schematic perspective view illustrating an inductor according to a sixth embodiment in the present disclosure.

Referring to FIG. 13, the inductor 600 according to the sixth embodiment in the present disclosure may include a body 620, a first external electrode 540, and a second external electrode 550, as an example.

Meanwhile, since the first external electrode 540 and the second external electrode 550 correspond to the same components as those described above, detailed descriptions thereof are omitted, and may be substituted with the above descriptions.

The body 620 may be formed by stacking a plurality of insulating layers 630 on which coil patterns 622 are disposed. As an example, the plurality of insulating layers 630 may be sequentially stacked in a vertical direction with respect to the mounting surface (i.e., a direction from a front surface to a rear surface of the body 620). Further, the insulating layer 630 may be a magnetic layer or a dielectric layer.

Where the insulating layer 630 is a dielectric layer, the insulating layer 630 may include $BaTiO_3$ (barium titanate)-based ceramic powder, or the like. In this case, examples of the $BaTiO_3$-based ceramic powder may include $(Ba_{1-x}Ca_x)TiO_3$, $Ba(Ti_{1-y}Ca_y)O_3$, $(Ba_{1-x}Ca_x)(Ti_{1-y}Zr_y)O_3$, $Ba(Ti_{1-y}Zr_y)O_3$, and the like, in which Ca, Zr, or the like, is partially solid-dissolved in $BaTiO_3$. However, the $BaTiO_3$-based ceramic powder in the present disclosure is not limited thereto.

Where the insulating layer 630 is a magnetic layer, the insulating layer 630 may include a proper material selected from materials that are usable as a body of an inductor, and examples of the proper material may include a resin, ceramic, ferrite, and the like.

In the present embodiment, the dielectric layer may be formed of a photosensitive insulating material, thereby implementing fine patterns through a photolithography process. In other words, by forming the dielectric layer with the photosensitive insulating material, the coil pattern 622 may be finely formed to contribute to miniaturization and function improvement of the inductor 600. To this end, the dielectric layer may include, for example, a photosensitive organic material or a photosensitive resin. In addition, the dielectric layer may further include an inorganic component such as $SiO_2/Al_2O_3/BaSO_4$/Talc, or the like, as a filler component.

The coil pattern 622 may have a plurality of layers, and neighboring coil patterns 622 may be electrically connected by a coil connection portion 622*a*. In other words, the helical coil pattern 622 may be connected by the coil connection portion 622*a* to form a coil. Both ends of the coil may be connected to the first and second external electrodes 540 and 550, respectively, by a coil lead portion 622*b*. The coil lead portion 622*b* may have a wider line width than that of the coil pattern 622 in order to improve connectivity between the coil patterns 622.

The coil pattern 622 may be formed of a material having excellent conductivity. For example, the coil pattern 622 may be formed of copper (Cu), aluminum (Al), tin (Sn), nickel (Ni), lead (Pb), silver (Ag), gold (Au), platinum (Pt), or alloys thereof. Further, the coil pattern 622 may be formed by a plating method or a printing method, but is not limited thereto.

Meanwhile, the body 620 may have a through-hole 610 formed therein. The through-hole 610 may have a shape corresponding to a shape of the coil pattern 622. In the present embodiment, the through-hole 610 may be formed to have a tetragonal shape corresponding to the shape of the coil pattern 622, but the shape of the through-hole 610 is not limited thereto and may be any one of elliptical shape and polygonal shape.

In addition, the coil pattern 622 may be exposed through the through-hole 610. In other words, an inner surface of the coil pattern 622 may be entirely exposed through the through-hole 610. That is, the through-hole 610 may have such a size that the inner surface of the coil pattern 622 may be exposed. In addition, the through-hole 610 may be processed by drilling, laser, or the like depending on the material.

As described above, the insulating layer 630 formed of a dielectric that interrupts flow of magnetic flux of the coil pattern 622 may be removed from an inside of the coil pattern 622 through the through-hole 610, such that higher Q characteristics and a high self resonant frequency (SRF) may be implemented.

The insulating film 660 may be formed to prevent corrosion of the coil pattern 622 due to moisture. The insulating film 660 may be formed of a thermoplastic insulating material or a thermosetting insulating material different from a material of the insulating layer 630. As an example, the insulating film 660 may be formed on an inner surface of the insulating layer 630 to cover the coil pattern 622 exposed through the through-hole 610.

Even though a case in which the insulating film 660 is entirely formed on the inner surface of the insulating layer 630 is described as an example in the present embodiment, the present disclosure is not limited thereto, and the insulating film 660 may be formed to cover only the coil pattern 622 to be exposed.

As set forth above, according to exemplary embodiments in the present disclosure, there is provided an inductor capable of implementing a high self resonant frequency (SRF) and high Q characteristics.

While exemplary embodiments have been shown and described above, it will be apparent to those skilled in the art that modifications and variations could be made without departing from the scope of the present invention as defined by the appended claims.

What is claimed is:

1. An inductor comprising:

a body including a plurality of insulating layers and a plurality of coil patterns disposed on the plurality of insulating layers, respectively, in a stacking direction; and first and second external electrodes disposed on an exterior surface of the body, wherein the body further includes a through-hole, at least one portion of an inner surface of coil patterns, among the plurality of coil patterns, disposed on adjacent insulating layers in the stacking direction, among the plurality of insulating layers, is exposed through the through-hole and at least another portion of the inner surface of said coil patterns is unexposed through the through-hole, and the at least another portion of the inner surface of each of said coil patterns extends about the through-hole such that different parts of the at least another portion of the inner surface of each of said coil patterns oppose each other in a direction perpendicular to the stacking direction extending through the through-hole.

2. The inductor of claim 1, wherein the plurality of coil patterns include silver (Ag), gold (Au), platinum (Pt), or alloys thereof.

3. The inductor of claim 1, wherein the through-hole has any one of an elliptical shape, a circular shape, or a polygonal shape.

4. The inductor of claim 1, wherein the plurality of coil patterns are stacked in parallel with respect to a mounting surface of a board.

5. The inductor of claim 1, wherein the plurality of coil patterns are disposed vertically with respect to a mounting surface of a board.

* * * * *